US007954813B2

(12) United States Patent
Matsumoto

(10) Patent No.: US 7,954,813 B2
(45) Date of Patent: Jun. 7, 2011

(54) SHEET CONVEYING DEVICE AND CONTROL METHOD THEREFOR

(75) Inventor: Yuzo Matsumoto, Abiko (JP)

(73) Assignee: Canon Kabushiki Kaisha (JP)

( * ) Notice: Subject to any disclaimer, the term of this patent is extended or adjusted under 35 U.S.C. 154(b) by 180 days.

(21) Appl. No.: 12/145,617

(22) Filed: Jun. 25, 2008

(65) Prior Publication Data

US 2009/0001662 A1 Jan. 1, 2009

(30) Foreign Application Priority Data

Jun. 27, 2007 (JP) ..... 2007-169141

(51) Int. Cl.
*B65H 5/34* (2006.01)

(52) U.S. Cl. ..... 271/270

(58) Field of Classification Search ..... 271/270
See application file for complete search history.

(56) References Cited

U.S. PATENT DOCUMENTS

| | | | | |
|---|---|---|---|---|
| 6,647,241 | B2 * | 11/2003 | Harashima | 399/389 |
| 2002/0063384 | A1 * | 5/2002 | Quesnel | 271/270 |
| 2004/0217541 | A1 * | 11/2004 | Horio | 271/121 |

FOREIGN PATENT DOCUMENTS

| | | | |
|---|---|---|---|
| JP | 03-002068 | A | 1/1991 |

* cited by examiner

*Primary Examiner* — Michael C McCullough
(74) *Attorney, Agent, or Firm* — Rossi, Kimms & McDowell LLP

(57) ABSTRACT

A sheet conveying device that is capable of performing a stable sheet conveying operation without being influenced by a characteristic of a sheet. A sheet conveying device includes lots of conveying roller pairs configured to convey a sheet by nipping the same and conveying motors configured to drive the respective conveying roller pairs. A downstream conveying roller pair and an upstream conveying roller pair cooperate with each other to convey the sheet by nipping the same. A CPU controls the conveying motors such that the circumferential speed of the downstream conveying roller pair becomes lower than that of the upstream conveying roller pair. The speed difference in circumferential speed between the downstream conveying roller pair and the upstream conveying roller pair is changed according to a characteristic of the sheet.

6 Claims, 11 Drawing Sheets

| SHEET BASIS WEIGHT | AMOUNT OF CHANGE IN CONVEYING SPEED △V(mm/s) | ΔV WHEN V0 = 1000(mm/s) |
|---|---|---|
| ≦ 50 g/m2 | 0.030 * V0 | 30 |
| 51 ~ 100 g/m2 | 0.020 * V0 | 20 |
| 101 ~200 g/m2 | 0.015 * V0 | 15 |
| 201 ~250 g/m2 | 0.012 * V0 | 12 |
| 251 ~300 g/m2 | 0.010 * V0 | 10 |
| 301 ~350 g/m2 | 0.007 * V0 | 7 |
| 351 ~400 g/m2 | 0.005 * V0 | 5 |
| ≧ 401 g/m2 | 0.001 * V0 | 1 |

FIG. 6

--WARNING
THE DRIVING FREQUENCY OF THE MOTOR M1 HAS EXCEEDED SPECIFICATION VALUE AFTER SPEED ADJUSTMENT. RELIABLE SHEET CONVEYANCE MAY NOT BE PERFORMED.

IS IT OK TO CHANGE SHEET CONVEYING SPEED FROM 1000 mm/s TO 990 mm/s?
IN THIS CASE, PRODUCTIVITY WILL CHANGE FROM 100 ppm TO 97 ppm.

Yes

No

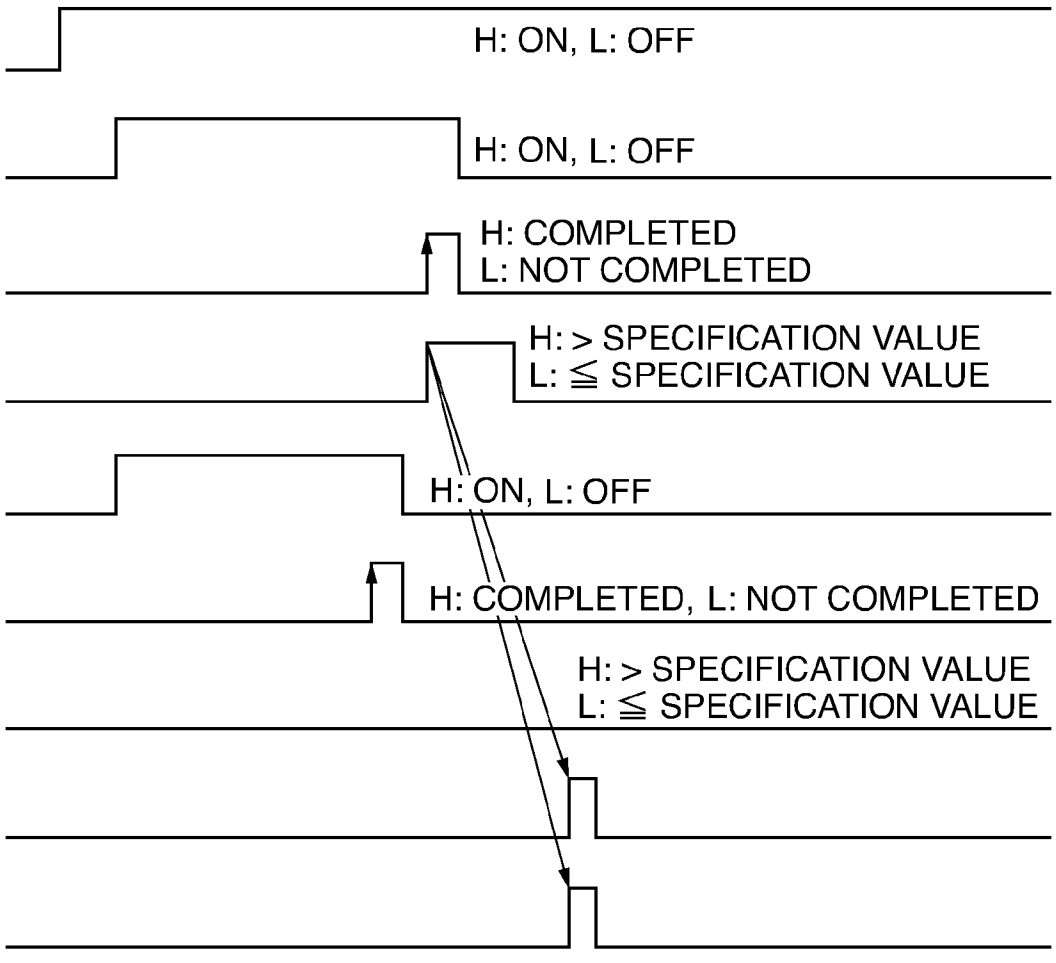
*FIG. 7A* ROLLER SPEED ADJUSTMENT MODE
*FIG. 7B* MOTOR M1 ADJUSTMENT
*FIG. 7C* MOTOR M1 ADJUSTMENT END
*FIG. 7D* MOTOR M1 SPECIFICATION-OVER
*FIG. 7E* MOTOR M2 ADJUSTMENT
*FIG. 7F* MOTOR M2 ADJUSTMENT END
*FIG. 7G* MOTOR M2 SPECIFICATION-OVER
*FIG. 7H* MOTOR M1 FREQUENCY CHANGE
*FIG. 7I* MOTOR M2 FREQUENCY CHANGE

FIG. 9

| SHEET BASIS WEIGHT | AMOUNT OF CHANGE IN CONVEYING SPEED △V(mm/s) | ΔV WHEN V0 = 1000(mm/s) |
|---|---|---|
| ≦ 50 g/m2 | 0.030 * V0 | 30 |
| 51 ~ 100 g/m2 | 0.020 * V0 | 20 |
| 101 ~200 g/m2 | 0.015 * V0 | 15 |
| 201 ~250 g/m2 | 0.012 * V0 | 12 |
| 251 ~300 g/m2 | 0.010 * V0 | 10 |
| 301 ~350 g/m2 | 0.007 * V0 | 7 |
| 351 ~400 g/m2 | 0.005 * V0 | 5 |
| ≧ 401 g/m2 | 0.001 * V0 | 1 |

SHEET CONVEYING DEVICE AND CONTROL METHOD THEREFOR

BACKGROUND OF THE INVENTION

1. Field of the Invention

The present invention relates to a sheet conveying device and a control method therefor, and more particularly to a sheet conveying device that conveys sheets using lots of conveying roller pairs and a method of controlling the sheet conveying device.

2. Description of the Related Art

Conventionally, in an image forming apparatus, such as a printer or a multifunction machine, a sheet for printing (for image formation) is conveyed using lots of conveying rollers. Each of these conveying rollers is comprised of a pair of a driving roller driven to rotate by a motor and a driven roller for pressing a sheet against the driving roller. A sheet is nipped between the driving roller driven to rotate and the driven roller in each of the conveying roller pairs and is passed from one roller pair to another. Thus, the sheet is conveyed.

In a sheet conveying mechanism configured as above, in the case of concurrently nipping one sheet by a plurality of roller pairs, it is required to match a sheet conveying speed between the roller pairs for concurrently nipping the sheet. In general, this control for matching the sheet conveying speed is performed by controlling the rotational speed of each driving roller. However, variation in the roller diameters of the respective driving rollers and mounting tolerance thereof can make the actual sheet conveying speed different between an upstream driving roller and a downstream driving roller concurrently nipping a sheet.

To solve this problem, there has been proposed a device provided with a correction means for detecting an error amount between the conveying speed of a driving roller and a target speed, and correcting the conveying speed based on the detected error amount (see Japanese Patent Laid-Open Publication No. H03-002068).

However, even if conveying speed information is corrected as disclosed in Japanese Patent Laid-Open Publication No. H03-002068, it is difficult to obtain a perfect match between the conveying speed of an upstream conveying roller pair and that of a downstream conveying roller pair. This sometimes causes a trouble, such as the loss of synchronization of motors for driving respective conveying roller pairs, particularly depending on the type (characteristic) of sheets.

SUMMARY OF THE INVENTION

The present invention provides a sheet conveying device that is capable of performing a stable sheet conveying operation without being influenced by a characteristic of a sheet, and a method of controlling the sheet conveying device.

In a first aspect of the present invention, there is provided a sheet conveying device comprising a first conveying roller pair configured to convey a sheet by nipping the sheet, a second conveying roller pair disposed upstream of the first conveying roller pair and configured to cooperate with the first conveying roller pair to convey the sheet by nipping the sheet, a first driving unit configured to drive the first conveying roller pair, a second driving unit configured to drive the second conveying roller pair; and a control unit configured to control the first driving unit and the second driving unit such that a circumferential speed of the first conveying roller pair becomes lower than a circumferential speed of the second conveying roller pair, wherein the control unit controls the first driving unit and the second driving unit such that a speed difference in circumferential speed between the first conveying roller pair and the second conveying roller pair is changed according to a characteristic of the sheet.

With the arrangement of the first aspect of the present invention, it is possible to carry out a stable sheet conveying operation without being influenced by a characteristic of a sheet.

In a second aspect of the present invention, there is provided a method of controlling a sheet conveying device including a first conveying roller pair configured to convey a sheet by nipping the sheet, a second conveying roller pair disposed upstream of the first conveying roller pair and configured to cooperate with the first conveying roller pair to convey the sheet by nipping the sheet, a first driving unit configured to drive the first conveying roller pair, and a second driving unit configured to drive the second conveying roller pair, comprising a control step of controlling the first driving unit and the second driving unit such that a circumferential speed of the first conveying roller pair becomes lower than a circumferential speed of the second conveying roller pair, wherein in the control step, the first driving unit and the second driving unit are controlled such that a speed difference in circumferential speed between the first conveying roller pair and the second conveying roller pair is changed according to a characteristic of the sheet.

The features and advantages of the invention will become more apparent from the following detailed description taken in conjunction with the accompanying drawings.

BRIEF DESCRIPTION OF THE DRAWINGS

FIG. 6 is a view of a warning message displayed in the conveying speed adjustment process.

FIGS. 7A to 7I are timing diagrams showing respective signals used in the conveying speed adjustment process.

FIG. 9 is a diagram illustrating a conveying speed difference table for use in the fine adjustment process.

DETAILED DESCRIPTION OF THE EMBODIMENTS

The present invention will now be described in detail with reference to the drawings showing a preferred embodiment thereof.

Figure 1:
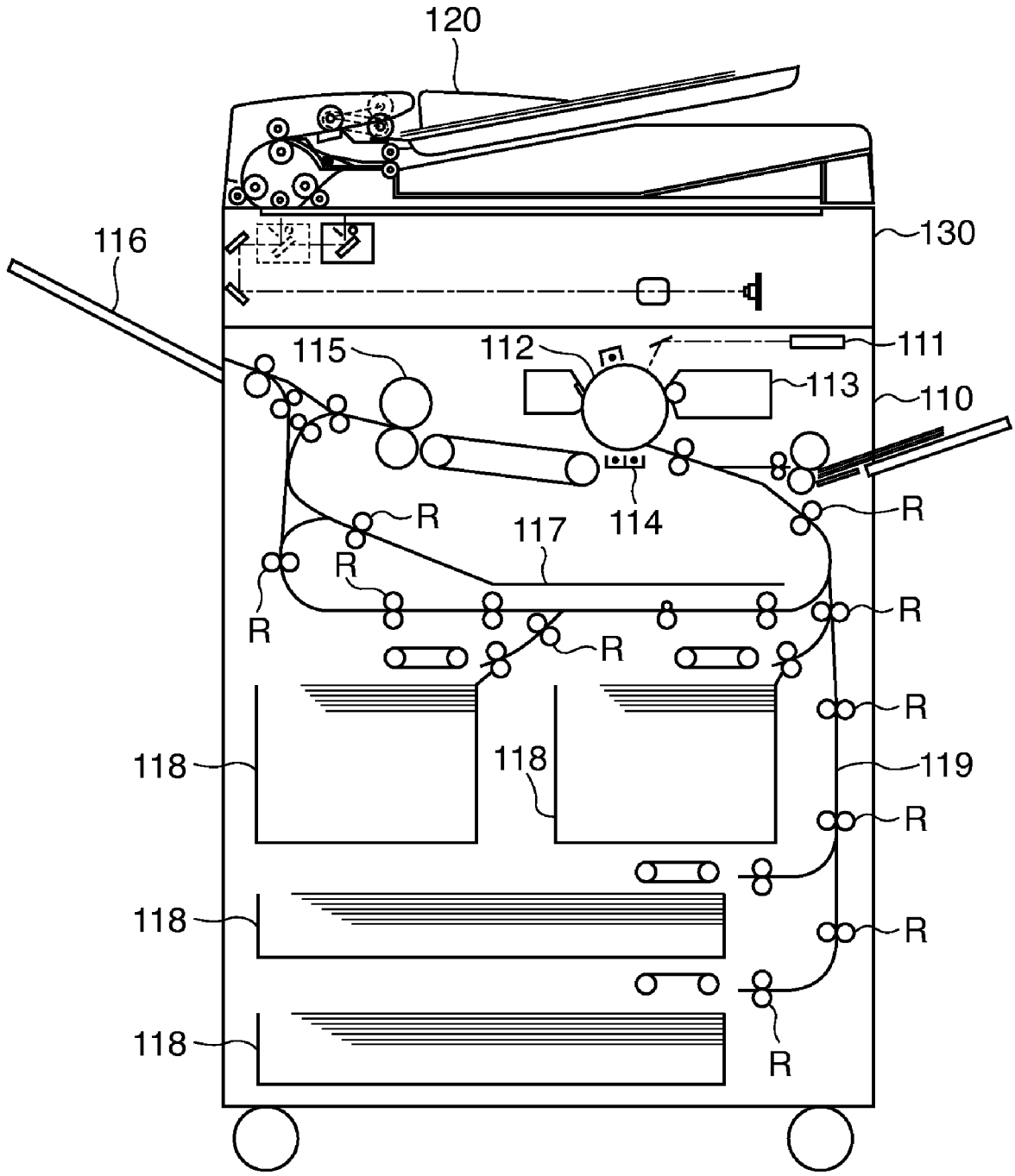
FIG. 1 is a schematic cross-sectional view of an image forming apparatus incorporating a sheet conveying device according to an embodiment of the present invention.

FIG. 1 is a schematic cross-sectional view of an image forming apparatus incorporating a sheet conveying device according to an embodiment of the present invention.

The image forming apparatus is comprised of a printer unit 110, a document feeder 120, and an image reading unit 130. The document feeder 120 feeds originals for reading, one by one, to the image reading unit 130. The image reading unit 130 optically reads an image on an original using solid image pickup devices, such as CCD, and converts the read image into electric image data, followed by transferring the electric image data to the printer unit 110.

In the printer unit 110, various types of image processing are performed on the image data, and laser light corresponding to the image data having undergone the image processing is emitted from a laser scanner unit 111. A photosensitive drum 112 is exposed to and scanned by the laser light, whereby an electrostatic latent image is formed on the surface of the photosensitive drum 112. The electrostatic latent image on the photosensitive drum 112 is developed into a toner image by a developing device 113.

On the other hand, sheets contained in sheet cassettes 118 are each conveyed by conveying roller pairs R on a conveying path 119 to a transfer position in a transfer section 114. The operation for conveying each sheet to the transfer position is performed in timing synchronous with the operation for forming the electrostatic latent image on the photosensitive drum 112. The sheet having the toner image transferred thereon is guided to a fixing section 115 to be subjected to processing for fixing the toner image thereon.

In single-sided printing, the sheet having undergone the fixing processing is discharged onto a discharge tray 116, while in double-sided printing, it is delivered to a re-feeding conveying path 117.

Figure 2:
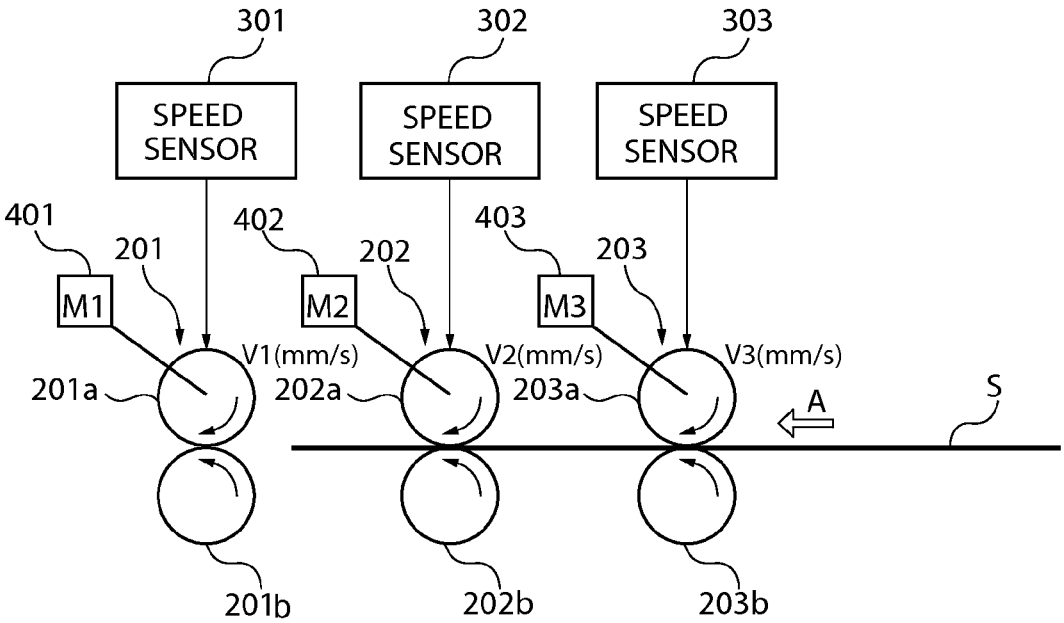
FIG. 2 is a schematic view of the sheet conveying device.

As shown in FIG. 1, the conveying path 119 and the re-feeding conveying path 117 are provided with the lots of conveying roller pairs R. The conveying roller pairs R are configured as shown in FIG. 2. It should be noted that when it is necessary to distinguish the lots of conveying roller pairs R from each other, the conveying roller pairs R are referred to as the roller pairs 201, 202, 203, . . . , respectively, as in FIGS. 2, 8A and 8B, and 12A to 12C.

FIG. 2 is a view showing an example of a plurality of conveying roller pairs arranged along the conveying path 119. The conveying roller pair 201 is comprised of a driving roller 201*a* and a driven roller 201*b*, and the conveying roller pair 202 disposed upstream of the conveying roller pair 201 in a sheet conveying direction is comprised of a driving roller 202*a* and a driven roller 202*b*. The conveying roller pair 203 disposed further upstream in the sheet conveying direction is comprised of a driving roller 203*a* and a driven roller 203*b*. The driving rollers 201*a*, 202*a*, and 203*a* are driven to rotate separately by a conveying motor (M1) 401, a conveying motor (M2) 402, and a conveying motor (M3) 403, respectively. It should be noted that each of the conveying motors (M1) 401, (M2) 402, and (M3) 403 is implemented by a stepper motor. These conveying motors (M1) 401, (M2) 402, and (M3) 403 will be generically referred to as the conveying motors M.

Each of the driven rollers 201*b*, 202*b*, and 203*b* is urged and pressed against an associated one of the driving rollers 201*a*, 202*a*, and 203*a*, by an associated urging member, not shown. Further, each of the driving rollers 201*a*, 202*a*, and 203*a* and an associated one of the driven rollers 201*b*, 202*b*, and 203*b* can be separated from each other to form a slight gap therebetween.

Thus, when a sheet S is inserted in between the driving rollers 201*a*, 202*a*, and 203*a* and the driven rollers 201*b*, 202*b*, and 203*b* in a state of the driving rollers 201*a*, 202*a*, and 203*a* being rotated, the sheet S is conveyed in a predetermined direction (see an arrow A in FIG. 2) in a state nipped by the roller pairs.

Further, in the vicinity of each of the roller pairs 201, 202, and 203, there is disposed an associated one of speed sensors 301, 302, and 303 for detecting the conveying speed of the roller pair. In actuality, each of the speed sensors 301, 302, and 303 detects the speed (circumferential speed) of the associated one of the driving rollers 201*a*, 202*a*, and 203*a*.

The speed (circumferential speed) of each of the driving rollers 201*a*, 202*a*, and 203*a* indicates the conveying speed of the associated one of the roller pairs 201, 202, and 203 insofar as no slip occurs between the roller pair and the sheet S. The circumferential speed of each of the roller pairs 201, 202, and 203 is periodically adjusted, and then finely adjusted according to the kind (rigidity) of sheets S, described hereinafter.

The speed sensors 301, 302, and 303 are each implemented by a laser Doppler speed sensor.

Figure 3:
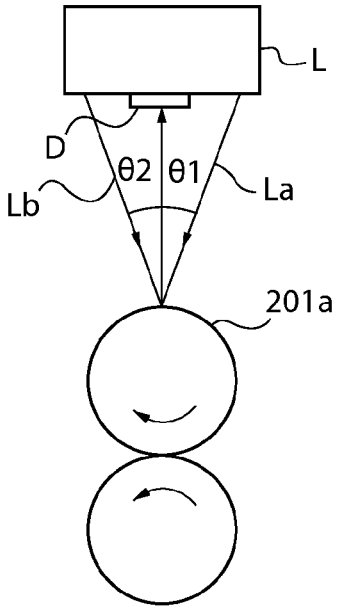
FIG. 3 is a schematic view of a speed sensor in the sheet conveying device.

FIG. 3 is a view useful in explaining detection of the circumferential speed of the driving roller 201*a* by the speed sensor 301. As shown in FIG. 3, the speed sensor 301 is comprised of a laser light source section L and a light receiving section D. The laser light source section L has a beam splitter for splitting a laser beam from one laser light source into two light fluxes, and is configured to irradiate the two laser beams La and Lb onto the driving roller 201*a* as a measurement object. In this case, incidence angles θ1 and θ2 of the respective laser beams La and Lb irradiated onto the measurement object are set to be equal to each other.

Lights scattered from the object irradiated with the two laser beams La and Lb are received by the light receiving section D. In this case, the frequencies of the scattered lights produced by the laser beams La and Lb undergo respective Doppler shifts of +Δf and −Δf in proportion to a traveling speed (conveying speed) V of the object. Assuming that the wavelength of the laser beams La and Lb is represented by λ, the Doppler shift Δf can be determined by the following equation (1):

$$\Delta f = V \sin \theta / \lambda \tag{1}$$

The scattered lights having undergone the Doppler shifts of +Δf and −Δf interfere with each other to cause a change in brightness on the light receiving surface of the light receiving section D. The frequency of a scattered light, i.e. a Doppler frequency F, can be determined by the following equation (2):

$$F = 2\Delta f = 2V \sin \theta / \lambda \tag{2}$$

Thus, by measuring the Doppler frequency F of an output signal from the light receiving section D, it is possible to obtain the conveying speed (circumferential speed) V of the driving roller 201*a* as the measurement object based on the equation (2). The speed sensors 302 and 303 also detect a circumferential speed based on the same principle.

Figure 4:
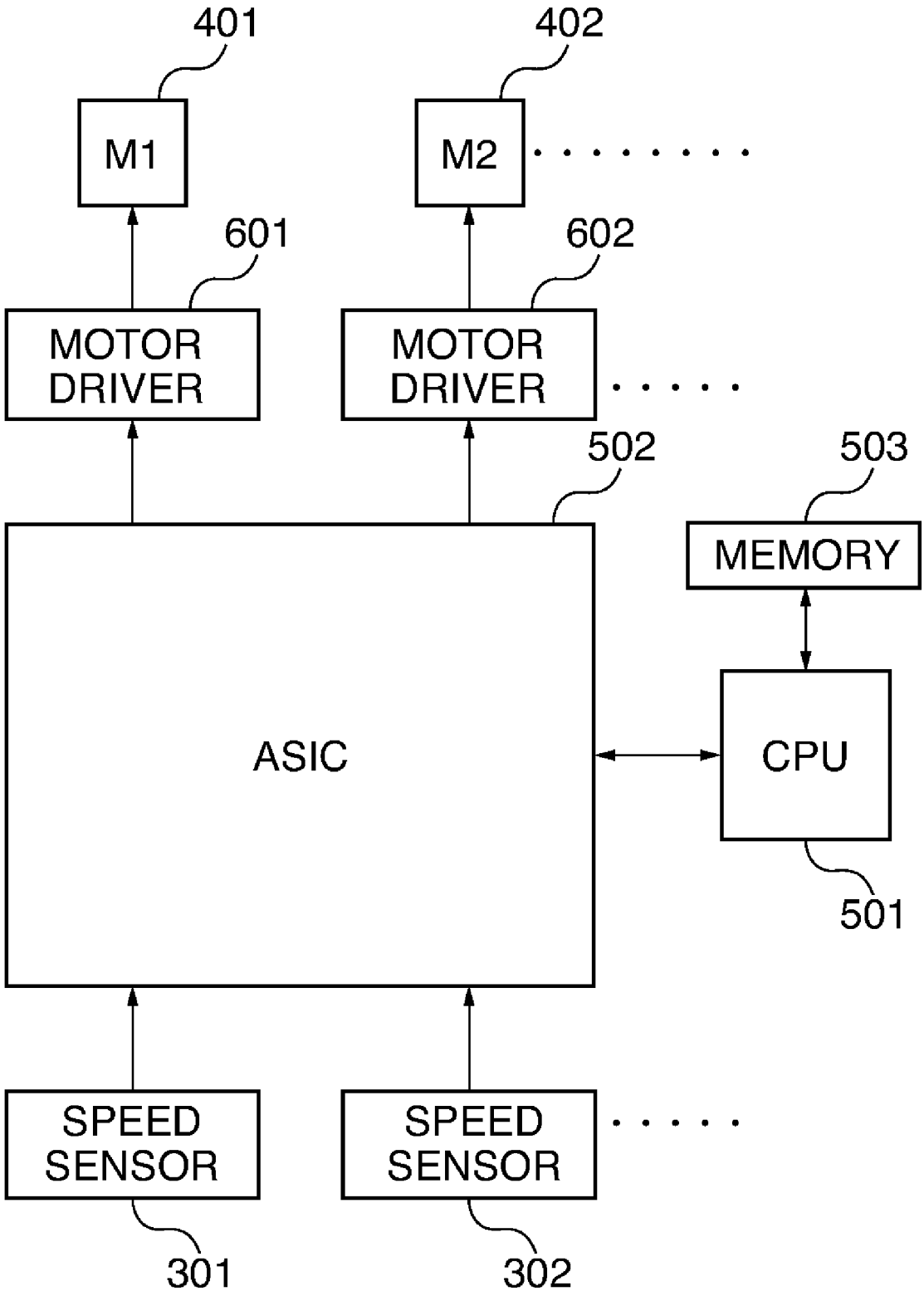
FIG. 4 is a block diagram of a control system of the sheet conveying device.

FIG. 4 is a block diagram of a control system of the sheet conveying device. Connected to a CPU 501 are a dedicated ASIC 502 for driving loads of the sheet conveying device, and a memory 503. The conveying motors (M1) 401, (M2) 402, . . . are connected to the ASIC 502 via motor drivers 601, 602, . . . , respectively. Further, the speed sensors 301, 302, . . . are connected to the ASIC 502. The memory 503 stores a conveying speed difference table (see FIG. 9) for use in setting the conveying speed of each conveying roller pair R according to a sheet basis weight, and specification values (target values) of the driving frequencies of the respective conveying motors (M1) 401, (M2) 402, . . . .

In conveying a sheet, the CPU 501 generally reads out the driving frequency (specification value) of each of the conveying motors (M1) 401, (M2) 402, . . . , and supplies the driving frequencies to the ASIC 502. The ASIC 502 supplies signals indicative of the driving frequencies received from the CPU 501 to respective associated motor drivers 601, 602, . . . . Each of the motor drivers 601, 602, . . . generates a pulse signal corresponding to the driving frequency indicated by the supplied signal, and drives an associated one of the conveying motors (M1) 401, (M2) 402, . . . to rotate, based on the generated pulse signal.

Normally, it is possible to convey a sheet at a desired speed by controlling sheet conveyance based on the above-mentioned specification values of the respective driving frequencies. However, the circumferential speed of each conveying roller pair R sometimes deviates from a target value e.g. depending on an initial state of the sheet conveying device, or due to wear of the roller of the conveying roller pair R caused by long-term use thereof.

In FIG. 2, it is assumed that the target speed of each of the conveying roller pairs 201, 202, and 203 is set to 1000 mm/s, for example. Actually, however, a case can occur where a conveying speed V1 of the conveying roller pair 201 changes to 990 mm/s, a conveying speed V2 of the conveying roller pair 202 changes to 1004 mm/s, and a conveying speed V3 of the conveying roller pair 203 changes to 993 mm/s, for example.

To cope with such a case, in the present embodiment, the speed sensors 301, 302, and 303 are connected to the ASIC 502 as mentioned above, to thereby measure the rotational speed of each of the conveying roller pairs 201, 202, and 203. More specifically, the ASIC 502 measures the Doppler frequencies F using the equation 2, based on the output signals from the light receiving sections D of the respective sensors 301, 302, and 303, to thereby calculate the rotational speed (circumferential speed) of each of the conveying roller pairs 201, 202, and 203.

The CPU 501 adjusts the rotational speed (circumferential speed) of each of the conveying roller pairs 201, 202, and 203 according to the calculated rotational speed. This speed adjustment for the conveying roller pairs R can be performed when the power of the apparatus is turned on, or whenever a predetermined number of sheets are conveyed, or when the user gives an operation command. Alternatively, the speed adjustment for the conveying roller pairs R may be performed when a difference in sheet conveying speed between any adjacent two of the conveying rollers R has exceeded a predetermined value.

Figure 5:
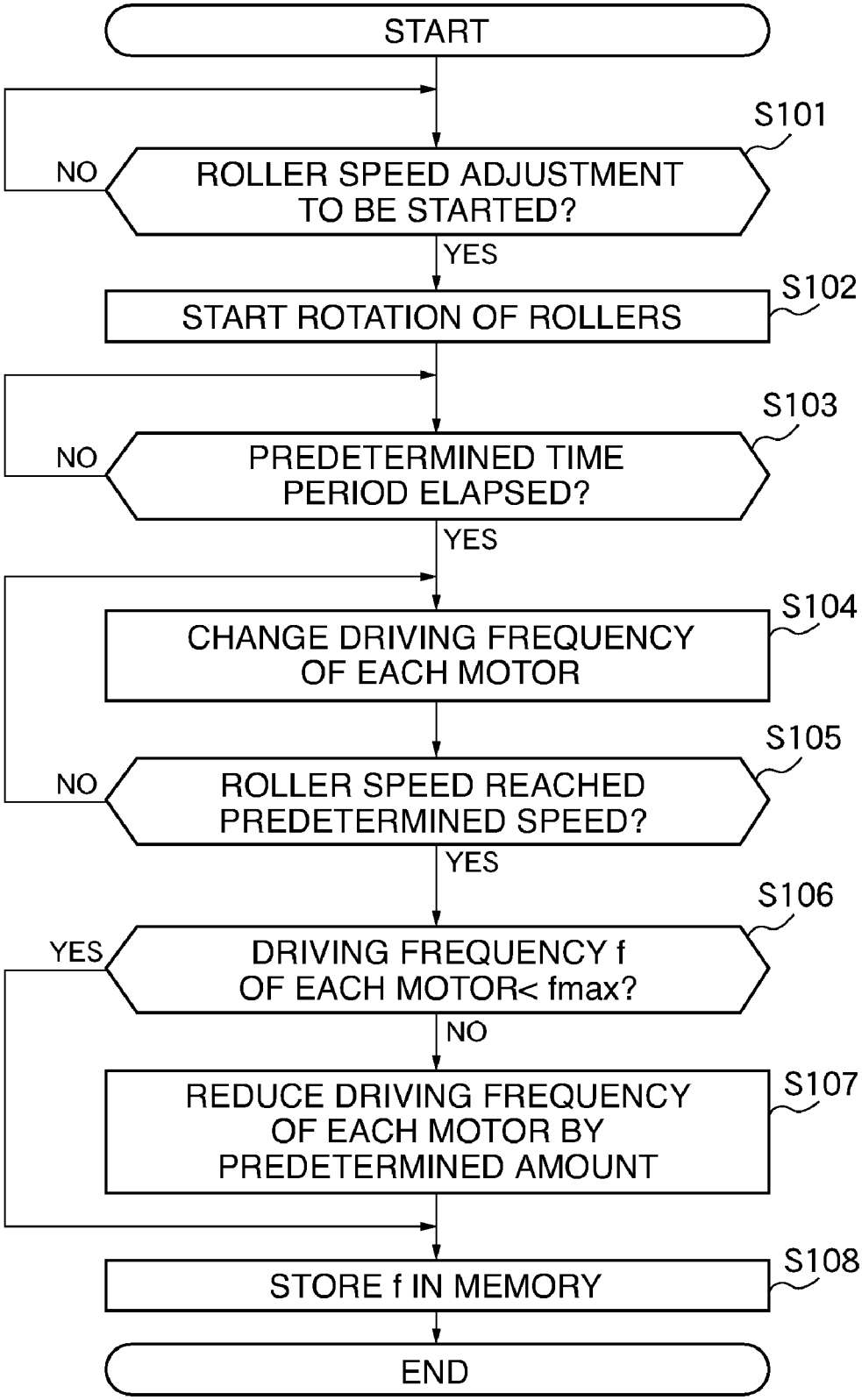
FIG. 5 is a flowchart of a conveying speed adjustment process executed by the sheet conveying device.

Next, a conveying speed adjustment process for adjusting the conveying speeds of the respective conveying roller pairs R will be described with reference to a flowchart in FIG. 5.

The CPU 501 determines whether or not it is time for starting the conveying speed adjustment process for adjusting the conveying speeds of the respective conveying roller pairs R (step S101). As mentioned above, the process is started when the power is turned on, or whenever a predetermined number of sheets are conveyed, or when the user gives an operation command. When it is time for adjustment, the CPU 501 starts rotation of each of the conveying roller pairs R (step S102). Then, when a predetermined time period has elapsed after the start of the rotation of the conveying roller pairs R (step S103), the CPU 501 changes the driving frequency of each conveying motor M to the specification value (target value) thereof to thereby perform speed adjustment (step S104).

Next, the CPU 501 determines whether or not the circumferential speed of each conveying roller pair R has reached the specification value (target value) (step S105). If the specification value has not been reached, the process returns to the step S104, wherein the CPU 501 further changes the motor driving frequency to increase the circumferential speed of each conveying roller pair R to the specification value. On the other hand, if it is determined in the step S105 that the circumferential speed of each conveying roller pair R has reached the specification value, the CPU 501 determines whether or not the driving frequency f of each conveying motor M is smaller than a predetermined maximum frequency fmax (step S106).

If the driving frequency f of each conveying motor M is smaller than the maximum frequency fmax, the CPU 501 stores the driving frequencies f of the respective conveying motors M to be adjusted in the memory 503 (step S108), followed by terminating the present speed adjustment process.

On the other hand, if at least one of the driving frequencies f of the respective conveying motors M having undergone speed adjustment is not smaller than the maximum frequency fmax, the CPU 501 uniformly reduces the driving frequencies f of the respective conveying motors M by a predetermined ratio (step S107). Then, the process proceeds to a step S108, wherein the CPU 501 stores the uniformly reduced driving frequencies f of the respective conveying motors M in the memory 503.

In the processing executed in the step S107 when at least one of the driving frequencies f of the respective conveying motors M having undergone speed adjustment is not smaller than the maximum frequency fmax, a warning message shown in FIG. 6 by way of example is displayed on an operation screen. This processing has a meaning described below.

It is assumed that each of the conveying motors M cannot secure sufficient conveying torque when the driving frequency thereof exceeds e.g. 1800 pps (pulse per second). Further, it is assumed that it is detected by the speed sensors 301 and 302 and the ASIC 502 that a conveying speed V1 of the conveying roller pair 201 is 965 mm/s, and a conveying speed V2 of the conveying roller pair 202 is 104 mm/s. Furthermore, it is assumed that during the above detection, the driving frequencies of the respective conveying motors 401 and 402 are both set to 1700 pps. Now, let it be assumed that the speed adjustment responsive to these results of detections by the sensors, intended to make both the conveying speeds V1 and V2 of the respective conveying roller pairs 201 and 202 to 1000 mm/s, changes a driving frequency f1 of the conveying motor 401 to 1809 pps, and a driving frequency f2 of the conveying motor 402 to 1695 pps.

In the case of this speed adjustment, the driving frequency f1 of the conveying motor 401 exceeds 1800 pps, which makes it impossible for the conveying motor 401 to secure sufficient conveying torque, and hence the CPU 501 displays the warning message shown in FIG. 6. The warning message warns the user that since the driving frequency of the conveying motor (M1) 401 has exceeded a predetermined value due to execution of the speed adjustment for the conveying roller pairs R, reliable sheet conveyance may not be performed, and inquires of the user whether the conveying speeds of the respective conveying roller pairs R should be uniformly changed from 1000 mm/s to 990 mm/s so as to ensure reliable sheet conveyance. In this case, when the user presses a "Yes" button on the warning display screen, the sheet conveying device changes the conveying speeds of the respective conveying roller pairs R uniformly from 1000 mm/s to 990 mm/s. As a consequence, the driving frequency f1 of the conveying motor (M1) 401 changes from 1809 pps to 1795 pps at which sufficient conveying torque can be secured.

It should be noted that the speed changing processing for achieving reliable sheet conveyance may be automatically (forcibly) performed without user approval, such as depression of the "Yes" button. In this case, only the warning message is displayed on the warning display screen in FIG. 6 without displaying either the "Yes" button or a "No" button. Alternatively, such a warning display as shown in FIG. 6 may not be presented at all. Further, the productivity of the device, i.e. the ratio by which the conveying speed is reduced may not be determined by the sheet conveying device, but e.g. by selectably displaying candidate productivities (reduction rates), it is also possible to cause the user to determine the productivity (ratio of speed reduction) through selection from the candidates. It should be noted that the productivity also corresponds to the number of sheets conveyed per unit time.

Next, a supplementary description will be given of the speed adjustment process for the conveying roller pairs R with reference to timing diagrams shown in FIGS. 7A to 7I. It should be noted that in FIGS. 7A to 7I, only two conveying roller pairs are taken as representatives of all the conveying roller pairs R, for convenience of description, and it is assumed that a conveying motor M2 is associated with the upstream one of the two conveying roller pairs, and a conveying motor M1 with the downstream pair. In the speed adjustment process for the conveying roller pairs R, the conveying roller pairs R are sequentially adjusted in order from the most upstream one to the most downstream one on the sheet conveying path (see FIGS. 7C and 7F, for comparison).

More specifically, when time comes for starting the speed adjustment process for the conveying roller pairs R, the CPU 501 turns on a speed adjustment mode signal to be supplied to the ASIC 502 (see FIG. 7A). When the speed adjustment mode signal is turned on, the ASIC 502 turns on adjustment signals for adjusting the conveying motors M for driving the respective conveying roller pairs R, and delivers the turned-on adjustment signals to the respective motor drivers 601, 602, . . . (see FIGS. 7B and 7E).

While the adjustment signals are kept on, each of the motor drivers 601, 602, . . . changes the driving frequency of the associated conveying motor M under the control of the ASIC 502. In this case, the ASIC 502 monitors each of the output signals from the respective speed sensors 301, 302, . . . to thereby determine whether or not the conveying speed of the associated conveying roller pair R has reached the target speed. Until the conveying speed of each conveying roller pair R reaches the target speed, the ASIC 502 continuously changes the driving frequency of the associated conveying motor M to supply a signal indicative of the driving frequency to an associated one of the motor drivers 601, 602, . . . .

Then, when the conveying speed of the conveying roller pair R reaches the target speed, the ASIC 502 turns on an adjustment end signal indicative of the end of adjustment of the associated conveying motor M (see FIGS. 7C and 7F). This adjustment end signal is delivered to the CPU 501. The CPU 501 latches the driving frequency of the conveying motor M at a rise edge of the adjustment end signal associated with the conveying motor M, and stores the driving frequency in the memory 503.

Referring to FIGS. 7C and 7F, as is apparent from the fact that the adjustment end signal associated with the conveying motor M2 is turned on first, and then the adjustment end signal associated with the conveying motor M1 is turned on, the ASIC 502 sequentially adjusts the conveying speeds of the respective conveying roller pairs R in order from the most upstream one to the most downstream one on the sheet conveying path.

Further, when the motor driving frequency for obtaining the target sheet conveying speed exceeds the specification value in at least one specification-over signal indicative of the fact (see FIG. 7D). When the specification-over signal is turned on, the CPU 501 displays the warning message shown in FIG. 6. Then, when the "Yes" button is pressed on the warning display screen, the CPU 501 turns on frequency change signals for changing the driving frequencies of the respective conveying motors M (see FIGS. 7H and 71). Thus, the ASIC 502 controls the motor drivers such that the driving frequencies of the respective conveying motors M will be uniformly reduced.

Figure 8A:
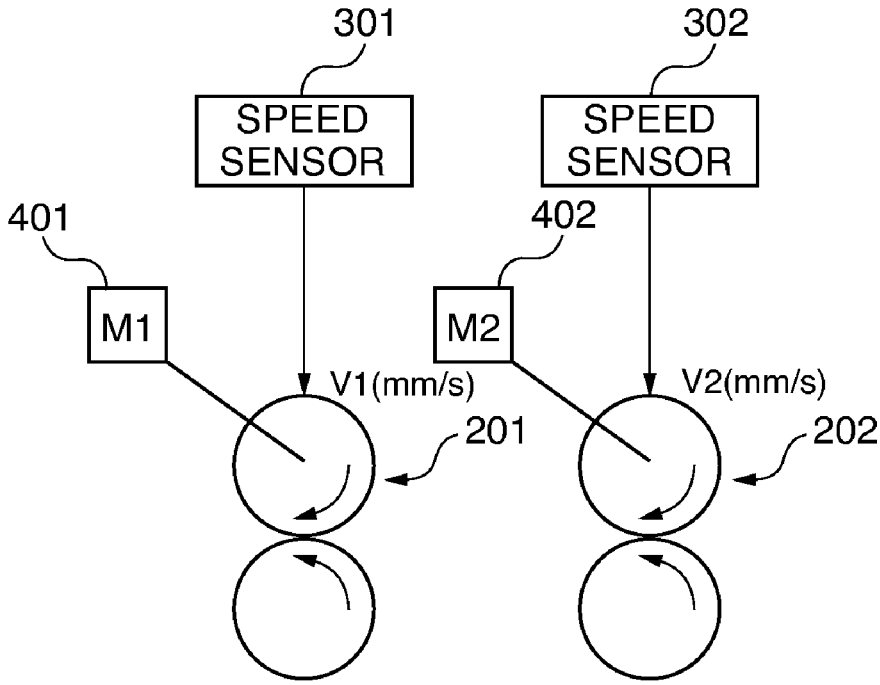
FIGS. 8A and 8B are views useful in explaining the necessity of a fine adjustment process to be performed after the conveying speed adjustment process.
Figure 8B:
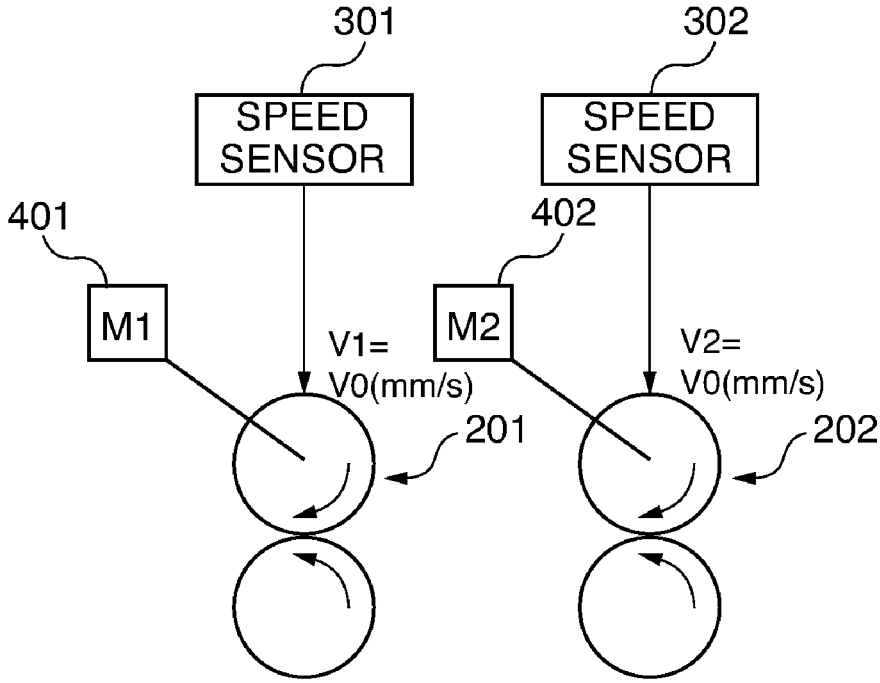

Even when the above-described speed adjustment is performed for each of the conveying roller pairs R, a difference in conveying speed is produced between the conveying roller pairs R in actuality. For example, in FIG. 8A, it is assumed that V1 is equal to 1004 mm/s, V2 is equal to 990 mm/s, and the driving frequencies of the respective conveying motors (M1) 401 and (M2) 402 at this time are both set to 1700 pps. In this case, let it be assumed that by execution of the above-described speed adjustment, the driving frequency f1 of the conveying motor (M1) 401 is changed to 1695 pps, and the driving frequency f2 of the conveying motor (M2) 402 is changed to 1730 pps. As a consequence, it is expected that the relationship in speed between the conveying roller pairs 201 and 202 will be V1=V2=V0=1000 mm/s, as shown in FIG. 8B.

However, at the time of measuring the speeds of the respective conveying roller pairs R or changing the motor frequencies for speed adjustment, a very small speed difference is actually produced between the conveying roller pairs R e.g. due to accuracy of speed detecting means, accuracy (variation) in changing the motor frequencies, or an error of quantization of control signals and the like.

It is practically very difficult to eliminate such a very small speed difference. Therefore, in the present embodiment, fine adjustment of the conveying speeds of the respective conveying roller pairs R is performed while tolerating that a very small speed difference is produced, but minimizing an adverse effect caused by the speed difference. More specifically, in the present embodiment, the fine adjustment is performed using a conveying speed difference table shown in FIG. 9 by way of example, such that the conveying speed of a downstream conveying roller pair R becomes lower than that of an associated upstream conveying roller pair R, and the speed difference between the two conveying roller pairs is inversely proportional to the rigidity of a sheet S. The reason for this can be explained as follows:

In a case where a sheet S is nipped and conveyed by adjacent two conveying roller pairs R, if the conveying speed of the downstream conveying roller pair R is higher than that of the upstream one, the sheet S is pulled between the two conveying roller pairs R. This pulling can cause a serious adverse effect, i.e. loss of synchronization of the associated conveying motors M. To prevent this, in the present embodiment, fine adjustment of the conveying speeds of the respective conveying roller pairs R is performed such that the conveying speed of the downstream conveying roller pair R becomes lower than that of the upstream one.

When the conveying speed of the downstream conveying roller pair R is lower than that of the upstream one, the upstream one acts to push the sheet S into the downstream one. In this case, when the basis weight (rigidity) of the sheet S is small, the flexibility of the sheet S is high, and therefore the sheet S is easily warped, which attenuates the pushing action. This prevents the sheet S from being damaged by the warpage. Further, slip of the sheet S can be prevented. Therefore, when the basis weight (rigidity) of a sheet S is small, it is important to set the difference in conveying speed between downstream and upstream conveying roller pairs R to a relatively large value to thereby facilitate fine adjustment of the conveying speeds of the respective conveying roller pairs R.

On the other hand, when the basis weight (rigidity) of the sheet S is large, the flexibility of the sheet S is low, and hence the pushing action cannot be attenuated, making the slip of the sheet S liable to occur. Further, the slippage of a sheet S is larger in proportion to the basis weight (rigidity) of the sheet S. Therefore, when the basis weight (rigidity) of the sheet S is large, it is important to reduce the difference in conveying speed between downstream and upstream conveying roller pairs R for strict fine adjustment of the conveying speeds of the respective conveying roller pairs R, to thereby prevent the slip of the sheet S.

For the reasons described above, according to the present embodiment, fine adjustment of the conveying speeds of the respective conveying roller pairs R is performed such that the conveying speed of a downstream conveying roller pair R becomes lower than that of an adjacent upstream conveying roller pair R, and the speed difference between the two conveying roller pairs is inversely proportional to the rigidity of a sheet S.

The fine adjustment is performed using the conveying speed difference table shown in FIG. 9, as described above. The conveying speed difference table is stored in the memory 503.

In the conveying speed difference table shown in FIG. 9, the conveying speed difference (amount of change in conveying speed) between the downstream and upstream conveying roller pairs R is expressed as a ratio with respect to the target speed V0 (including the specification value) so as to give general-purpose properties thereto.

Specifically, in the case of conveying a sheet S having a sheet basis weight of 50 g/m$^2$ or smaller, the conveying speed of the upstream conveying roller pair R is set to be 3% higher than that of the downstream conveying roller pair R. In the case of conveying a sheet S having a sheet basis weight of 401 g/m$^2$ or larger, the conveying speed of the upstream conveying roller pair R is set to be 0.1% higher than that of the downstream conveying roller pair R. In short, fine adjustment is performed such that the conveying speed of the downstream conveying roller pair R becomes lower than that of the upstream one, and the speed difference between the two roller pairs is inversely proportional to the rigidity of a sheet S.

It should be noted that in the conveying speed difference table shown in FIG. 9, the minimum value of the conveying speed difference is set to 0.1% of the target speed V0. This value is set in view of the fact that the accuracy in speed adjustment of the conveying roller pair R in the present sheet conveying device is set to 0.1% of the target speed V0. In other words, the conveying speed difference table is prepared than the accuracy in speed adjustment of the conveying roller pair R.

Further, in the case of conveying a sheet S having a large sheet basis weight e.g. of 400 g/m$^2$, if the conveying speed of a downstream conveying roller pair R is higher than that of the upstream one, pulling of the sheet S occurs. On the other hand, if the conveying speed of the downstream conveying roller pair R is lower than that of the upstream one, pushing of the sheet S into the downstream conveying roller pair R by the upstream one occurs. Therefore, it is required to perform control such that the speed difference between the two conveying roller pairs R becomes smaller in inverse proportion to the magnitude of the sheet basis weight.

Figure 10:
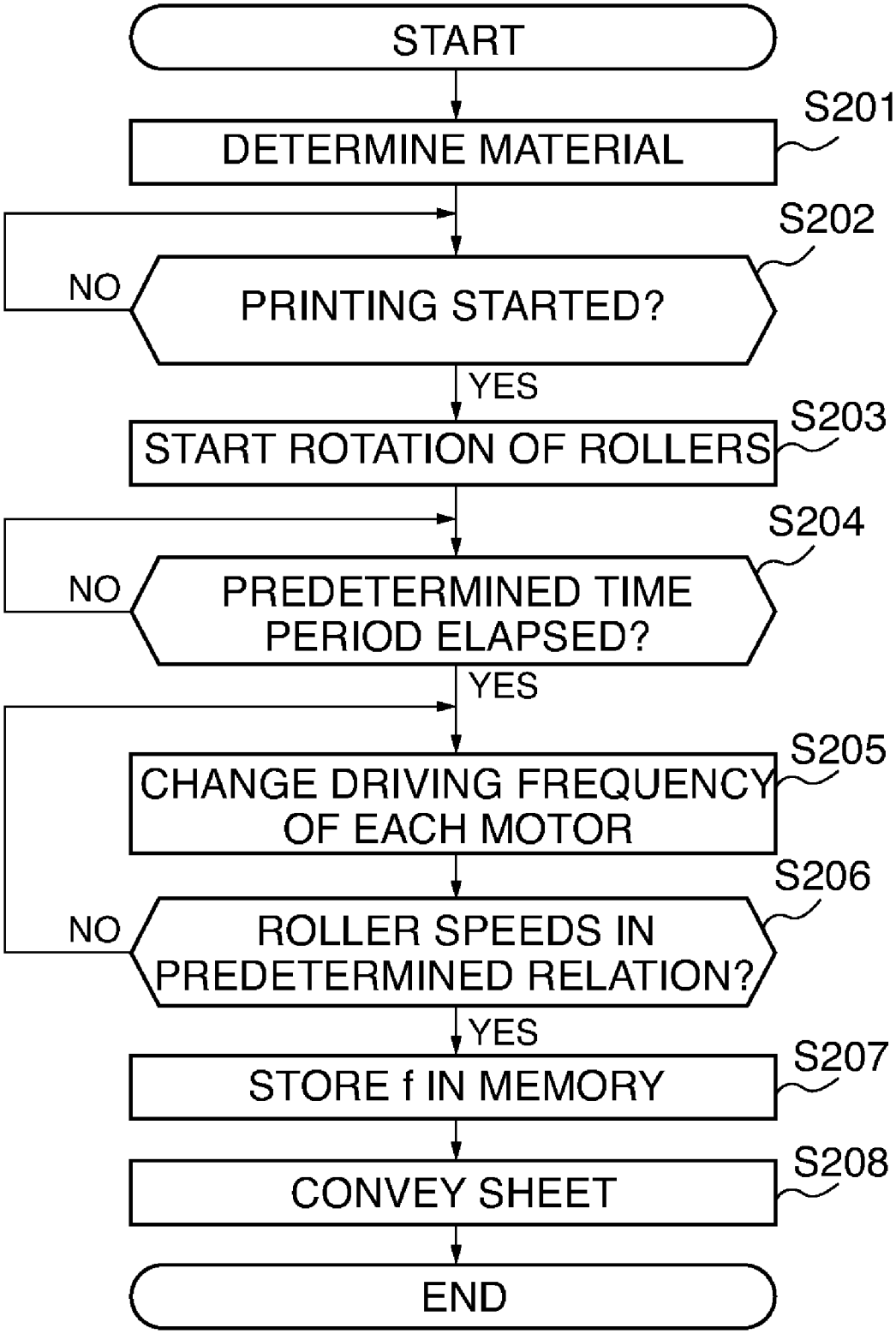
FIG. 10 is a flowchart of the fine adjustment process.
Figure 11:
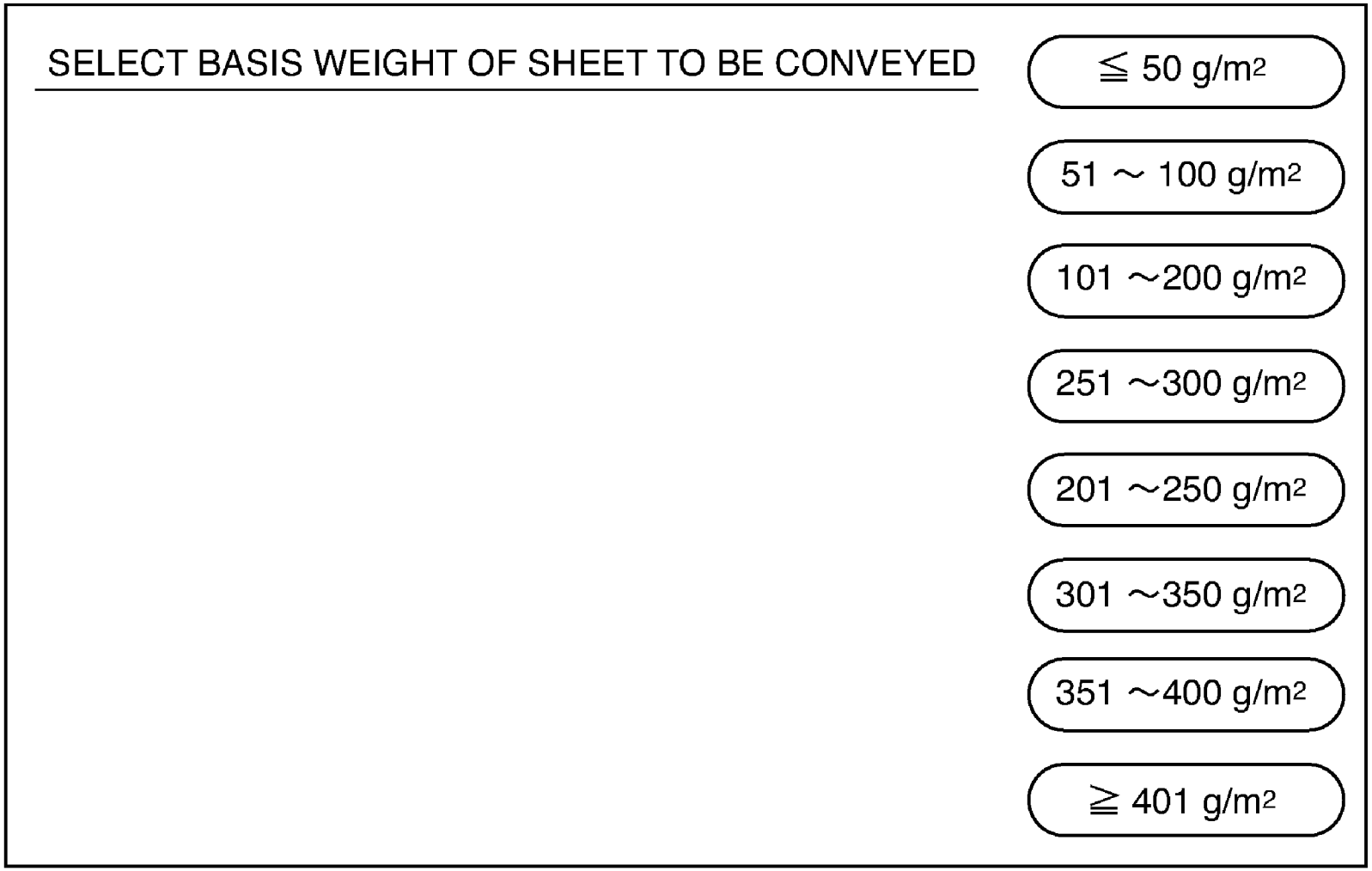
FIG. 11 is a view of a sheet basis weight selection screen for use in selecting a sheet basis weight based on which the fine adjustment process is performed.
Figure 12A:
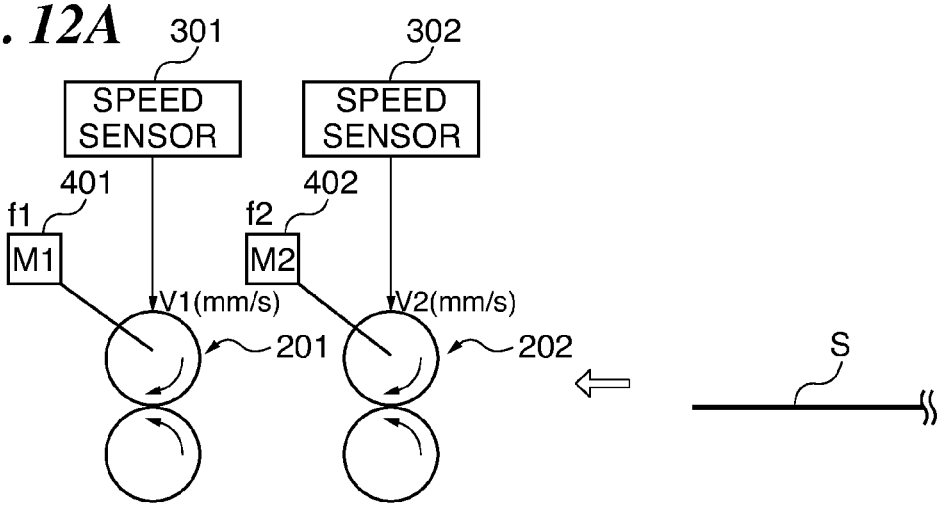
FIGS. 12A to 12C are views useful in explaining how and when the fine adjustment process is performed.
Figure 12B:
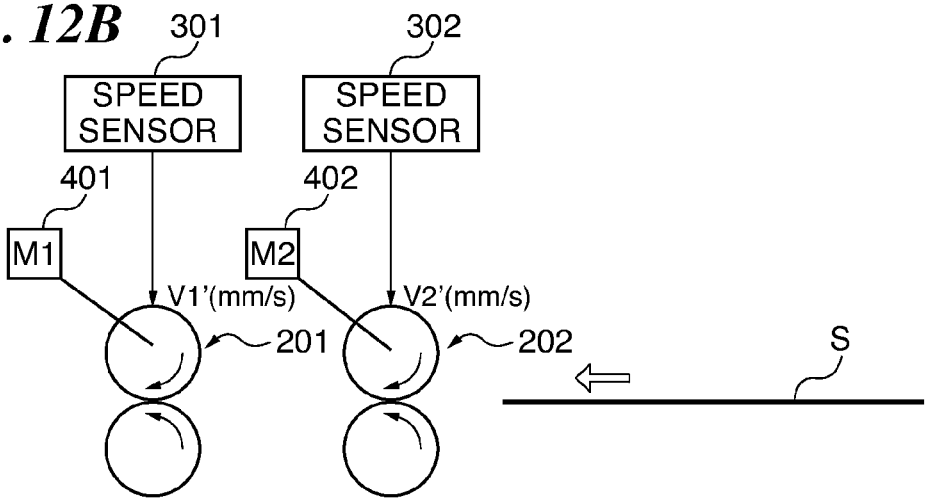
Figure 12C:
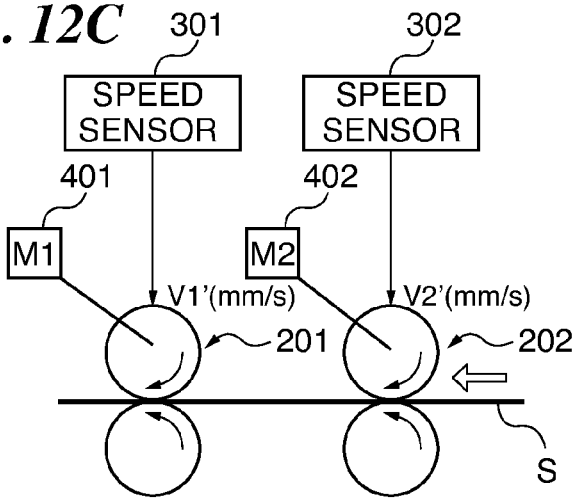

Next, the fine adjustment process for finely adjusting the conveying speeds of the respective conveying roller pairs R will be described with reference to a flowchart in FIG. 10. When a processing mode for executing an image forming process, such as a printing process or a copying process, is set, the CPU 501 determines a sheet basis weight (step S201). This determination is performed by displaying candidates of a sheet basis weight for selection, as shown in FIG. 11, and causing the user to select a desired sheet basis weight from the candidates.

Then, the CPU 501 determines whether or not, after the selection of the sheet basis weight, execution of the image forming process in the above-mentioned processing mode has been instructed (step S202). If execution of the image forming process has been instructed, the CPU 501 starts rotation of each of the conveying roller pairs R (step S203). Then, the CPU 501 determines whether or not a predetermined time period has elapsed after the start of the rotation of each of the conveying roller pairs R (step S204). If the predetermined time period has elapsed, the CPU 501 performs fine adjustment of speed by changing the driving frequencies of the respective conveying motors M based on the conveying speed difference table (step S205).

Next, the CPU 501 determines whether or not the relationship in speed between the conveying speeds of the respective conveying roller pairs R has become equal to a relationship represented by the speed difference associated with the selected sheet basis weight (step S206). If the difference in the conveying speeds of the respective conveying roller pairs R has become equal to the speed difference associated with the selected sheet basis weight, the CPU 501 stores the finely adjusted driving frequencies f of the respective conveying motors M in the memory 503 (step S207).

Thereafter, the CPU 501 starts conveying a sheet S (step S208). In this operation for conveying the sheet S, sheet conveyance is performed at the conveying speed (conveying speed difference) obtained by the fine adjustment, as can be inferred from reference numerals V1' and V2' appearing in FIGS. 12B and 12C.

When the conveying roller pairs R arranged along the conveying path are denoted e.g. by reference numerals R1, R2, R3, R4, . . . , respectively, in order from upstream to downstream, fine adjustment of the conveying speeds of the respective conveying roller pairs R is performed as follows: Suppose pairs of adjacent two conveying roller pairs, such as R1 and R2, R2 and R3, R3 and R4, . . . as respective combinations of conveying roller pairs arranged in the mentioned order from upstream to downstream, each combination of conveying roller pairs for concurrently nipping a sheet S. Then, the conveying speeds of two conveying roller pairs in each of the combinations are adjusted based on the conveying speed difference table such that the speed difference between the two conveying roller pairs becomes equal to a speed difference associated with the basis weight of the sheet S.

For this fine adjustment, the conveying speed of only one of the upstream one and the downstream one of two conveying roller pairs as a combination may be changed, and the conveying speed of the other may not. Alternatively, the conveying speeds of the respective upstream and downstream conveying roller pairs as a combination may both be changed (see FIGS. 12A and 12B).

The present invention is by no means limited to the above described embodiment, but each conveying motor M may be implemented any suitable type of motor other than the stepper motor, e.g. by a DC motor, for example. Further, the adjustment and fine adjustment processes for adjusting the conveying speeds of the respective conveying rollers may be performed while actually conveying one sheet.

Furthermore, the loads of the sheet conveying device may be controlled not by the dedicated ASIC, but by the CPU. In addition, the processing for selecting a sheet kind (rigidity)

may be performed not based on a sheet basis weight, but according to a sheet name, a sheet material, or the like.

It is to be understood that the present invention may also be accomplished by supplying a system or an apparatus with a storage medium in which a program code of software, which realizes the functions of the above described embodiment, is stored, and causing a computer (or CPU or MPU) of the system or apparatus to read out and execute the program code stored in the storage medium.

In this case, the program code itself read from the storage medium realizes the functions of the above described embodiment, and therefore the program code and the storage medium in which the program code is stored constitute the present invention.

Examples of the storage medium for supplying the program code include a floppy (registered trademark) disk, a hard disk, a magnetic-optical disk, an optical disk, such as a CD-ROM, a CD-R, a CD-RW, a DVD-ROM, a DVD-RAM, a DVD-RW, or a DVD+RW, a magnetic tape, a nonvolatile memory card, and a ROM. Alternatively, the program may be downloaded via a network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions This application claims priority from Japanese Patent Application No. 2007-169141 filed Jun. 27, 2007, which is hereby incorporated by reference herein in its entirety.

What is claimed is:

1. A sheet conveying device comprising:

a first conveying roller pair configured to convey a sheet by nipping the sheet;

a second conveying roller pair disposed upstream of said first conveying roller pair and configured to cooperate with said first conveying roller pair to convey the sheet by nipping the sheet;

a first driving unit configured to drive said first conveying roller pair;

a second driving unit configured to drive said second conveying roller pair; and a control unit configured to control said first driving unit and said second driving unit such that a target speed of a circumferential speed of said first conveying roller pair becomes lower than a target speed of a circumferential speed of said second conveying roller pair, wherein said control unit controls said first driving unit and said second driving unit such that, the smaller the rigidity of the sheet, the greater the speed difference between the target speed of the circumferential speed of said first conveying roller pair and the target speed of the circumferential speed of said second conveying roller pair.

2. A sheet conveying device as claimed in claim 1, wherein said control unit performs control for changing the speed difference while an adjustment process for adjusting the circumferential speeds of said first conveying roller pair and said second conveying roller pair to the target speeds, respectively, is being performed.

3. A sheet conveying device as claimed in claim 1, wherein said control unit controls one of said first driving unit and said second driving unit to thereby perform control for changing the speed difference.

4. A sheet conveying device as claimed in claim 1, wherein when a driving frequency of at least one of said first driving unit and said second driving unit respectively exceeds a specification value of said first driving unit and a specification value of said second driving unit during adjusting the circumferential speed of each of said first conveying roller pair and said second conveying roller pair to the target speeds, said control unit reduces the target speeds of said first conveying roller pair and said second conveying roller pair.

5. A sheet conveying apparatus as claimed in claim 4, further comprising a warning device that issues a warning to warn a user that at least one of said first driving unit and said second driving unit has exceeded a respective specification value of the at least one of said first driving unit and said second driving unit, and a control device to enable a user to select a lower sheet conveyance speed in response to said warning.

6. A method of controlling a sheet conveying device including a first conveying roller pair configured to convey a sheet by nipping the sheet, a second conveying roller pair disposed upstream of the first conveying roller pair and configured to cooperate with the first conveying roller pair to convey the sheet by nipping the sheet, a first driving unit configured to drive the first conveying roller pair, and a second driving unit configured to drive the second conveying roller pair, comprising:

a control step of controlling the first driving unit and the second driving unit such that a target speed of a circumferential speed of the first conveying roller pair becomes lower than a target speed of a circumferential speed of the second conveying roller pair, wherein said control step said first driving unit and said second driving unit are controlled such that, the smaller the rigidity of the sheet, the greater the speed difference between the target speed of the circumferential speed of said first conveying roller pair and the target speed of the circumferential speed of said second conveying roller pair.

* * * * *